US010773884B1

(12) United States Patent
Jarvis et al.

(10) Patent No.: US 10,773,884 B1
(45) Date of Patent: Sep. 15, 2020

(54) REMOVAL TOOL FOR AGRICULTURAL BIN RUNNERS AND METHODS FOR USING THE SAME

(71) Applicants: Michael Jarvis, Visalia, CA (US); Martin Matamoros, Porterville, CA (US)

(72) Inventors: Michael Jarvis, Visalia, CA (US); Martin Matamoros, Porterville, CA (US)

( * ) Notice: Subject to any disclaimer, the term of this patent is extended or adjusted under 35 U.S.C. 154(b) by 0 days.

(21) Appl. No.: 16/661,926

(22) Filed: Oct. 23, 2019

(51) Int. Cl.

| | |
|---|---|
| ***B25B 27/00*** | (2006.01) |
| ***B65D 19/38*** | (2006.01) |
| ***B65D 90/16*** | (2006.01) |
| ***B65D 90/14*** | (2006.01) |

(52) U.S. Cl.
CPC ..... *B65D 90/146* (2013.01); *B65D 19/38* (2013.01); *B65D 90/16* (2013.01)

(58) Field of Classification Search
None
See application file for complete search history.

(56) References Cited

U.S. PATENT DOCUMENTS 6,840,505 B1 * 1/2005 Sharp ..... B25C 11/00 254/130
2006/0245873 A1 * 11/2006 Black ..... B60S 13/00 414/458

* cited by examiner

*Primary Examiner* — Brian D Keller
(74) *Attorney, Agent, or Firm* — Marcus N. DiBuduo; John R. Aaron

(57) ABSTRACT

A tool for removing a runner from an agricultural bin having a lever arm and a plurality of crossbars. The lever arm may be directly, or indirectly, engaged with a rotatable crossbar which may have a plurality of protrusions for engaging corresponding tabs of a runner. To use the tool, a user may align the protrusions of the rotatable crossbar with the corresponding tabs of a runner engaged within a leg of an agricultural bin, then the user may press down on the lever arm, causing the crossbar to rotate and engage the tabs. As the user continues to press down on the lever arm, the tabs eventually disengage from corresponding openings in the leg of the agricultural bin, allowing the user to remove the runner from the bin.

20 Claims, 7 Drawing Sheets

REMOVAL TOOL FOR AGRICULTURAL BIN RUNNERS AND METHODS FOR USING THE SAME

FIELD OF THE INVENTION

The present invention concerns a tool and methods for removing a runner from an agricultural bin. More particularly, some embodiments of the present invention concern a tool having a lever arm engaged directly, or indirectly, with an engagement portion comprising a series of crossbars which can attach to a runner on the bottom of an agricultural bin. The tool may have one or more protrusions on a portion of a crossbar which can engage one or more corresponding tabs on a runner to disengage the tab(s) of the runner from corresponding grooves, or openings, in an agricultural bin.

BACKGROUND OF THE INVENTION

Agricultural bins (also known as commodity bins, produce bins, and harvest bins) are often used in the farming industry, as well as other related industries. Agricultural bins are useful for both storage and transport of mass quantities of agricultural products, such as fruits, vegetables, and grain, as well as animal feed. Such bins are typically made from durable plastic and designed to be handled by a forklift, making it easier to transport and store the bins. To prevent wear and damage, as well as to provide holding strength, a bin may be equipped with rails and/or feet (hereinafter referred to, generally, as "runners") which are attached to the bottom or underside of the bin. In some cases, a runner may extend along the bottom of a leg and/or between multiple legs of a bin.

Runners are typically secured to a bin by means of one or more tabs which engage a corresponding groove or opening formed in a leg of the bin, locking the runner into place. Since runners are frequently in contact with the ground and machinery, they tend to wear out before the bin to which they are attached does—thus requiring periodic replacement. However, runners are exceptionally difficult to remove from a bin, due to their high durability and robust locking mechanism. In fact, removing runners from a single bin may require multiple hours of manual labor, which may include drilling, sawing, and/or hammering to completely remove the runners. As a result, a user or company may forego replacement of the runners and instead replace the entire bin, which is both costly and an inefficient use of resources. Therefore, there exists a need for a mechanism by which a runner can be swiftly and easily removed. More particularly, the need exists for a mechanism which reduces the amount of human resources and labor required to remove a runner.

BRIEF SUMMARY OF THE INVENTION

Embodiments of the present invention pertain to a tool which can be used to remove, or extract, a runner from an agricultural bin. In some embodiments, a tool may generally comprise a lever arm and an engagement portion. In some embodiments, the engagement portion may include one or more crossbars, preferably made from metal or steel, for securing and/or engaging a leg of an agricultural bin. In preferred embodiments, the engagement portion may comprise an engagement crossbar, a proximal crossbar, a lateral crossbar, and a pair of side pieces. In some embodiments, the lever arm may be integrally formed with the engagement crossbar, or, alternatively, it may be removably engaged with the engagement crossbar by means of an opening or slot therein through which the lever arm can be inserted. In the latter case, the tool may include an opening or slot through which a removable lever arm can be inserted and stored when not in use.

According to some embodiments of the present invention, a proximal crossbar and a lateral crossbar of the engagement portion of a tool may be used to secure the tool on a leg of an agricultural bin. In some embodiments, an integrally formed handle may be disposed on a side of a crossbar which may be used to help a user secure the engagement portion of the tool around a leg. In preferred embodiments, the proximal crossbar and the lateral crossbar may be parallel to the engagement crossbar—with the engagement crossbar and the proximal crossbar on a same side of the engagement portion and with the lateral crossbar disposed at an opposite side of the engagement portion. The distal ends of the proximal crossbar, lateral crossbar, and engagement crossbar may be connected to a pair of side pieces, such that one distal end of each may be engaged with a first side piece and the other distal end of each may be engaged with a second side piece.

In preferred embodiments of the present invention, the proximal crossbar and lateral crossbar may be fixedly engaged with each side piece and the engagement crossbar may be rotatably engaged with each side piece. In some embodiments, each end of the engagement crossbar may have a flange engaged with each side piece and secured thereto by means of a screw or bolt, or the like, through an opening in each flange and each side piece. In such embodiments, the engagement crossbar may be rotatable, relative to the proximal crossbar and lateral crossbar, around an axis aligned with the openings in each flange and each side piece. In contrast, in other embodiments, the engagement crossbar may lack flanges at each distal end, thereby being rotatable around its central axis. Furthermore, in some embodiments of the present invention, a tool may have side pieces which may include slots or openings which may allow a rotatable or non-rotatable engagement crossbar to slide forwards or backwards.

In accordance with some embodiments of the present invention, one or more protrusions may be disposed along the engagement crossbar for engaging one or more tabs of an agricultural bin runner. In preferred embodiments, the engagement crossbar may have a plurality of protrusions, the total number of which may be equal to the number of tabs disposed on a runner. The protrusions may be spaced and arranged such that they are centrally aligned with each corresponding tab when the tool has been engaged with a leg of a bin. In some embodiments, a distal end of a protrusion may be flat, the surface of which may be about parallel to the surface of a runner tab when the two portions are aligned with each other. In preferred embodiments, a distal end of a protrusion may be shaped such that a portion of the surface may be about perpendicular to the axial portion of the protrusion and an adjacent portion of its surface may be oblique (i.e., beveled). This configuration may help ensure constant contact between the protrusion and runner tab as the engagement crossbar rotates during use.

To use the tool to remove a runner, a user may first start by placing an agricultural bin upside down so that the legs are accessible. The user may then place the engagement portion around the leg which has the runner to be removed, such that the leg is between the engagement crossbar, proximal crossbar, lateral crossbar, and side pieces. The tool may be oriented such that the outer portion of the leg is supported by the proximal crossbar and the inner portion is secured by the lateral crossbar. Next, the user may align the protrusions on the engagement crossbar with the tabs of the runner. Once the tabs and protrusions are aligned, the user may press down on a portion of the lever arm, causing the engagement crossbar to rotate and engage the protrusions with the tabs. The user may then continue pressing down on the lever arm until the tabs are released and completely disengaged from their corresponding grooves, or openings. Once the tabs are freed, the user may finish removing the runner from the leg by hand.

DETAILED DESCRIPTION OF THE INVENTION

The invention, in its various aspects, will be explained in greater detail below. While the invention will be described in conjunction with several exemplary embodiments, the exemplary embodiments themselves do not limit the scope of the invention. Similarly, the exemplary illustrations in the accompanying drawings, where like elements have like numerals, do not limit the scope of the exemplary embodiments and/or invention, including any length, angles, or other measurements provided. Rather the invention, as defined by the claims, may cover alternatives, modifications, and/or equivalents of the exemplary embodiments.

Figure 1:
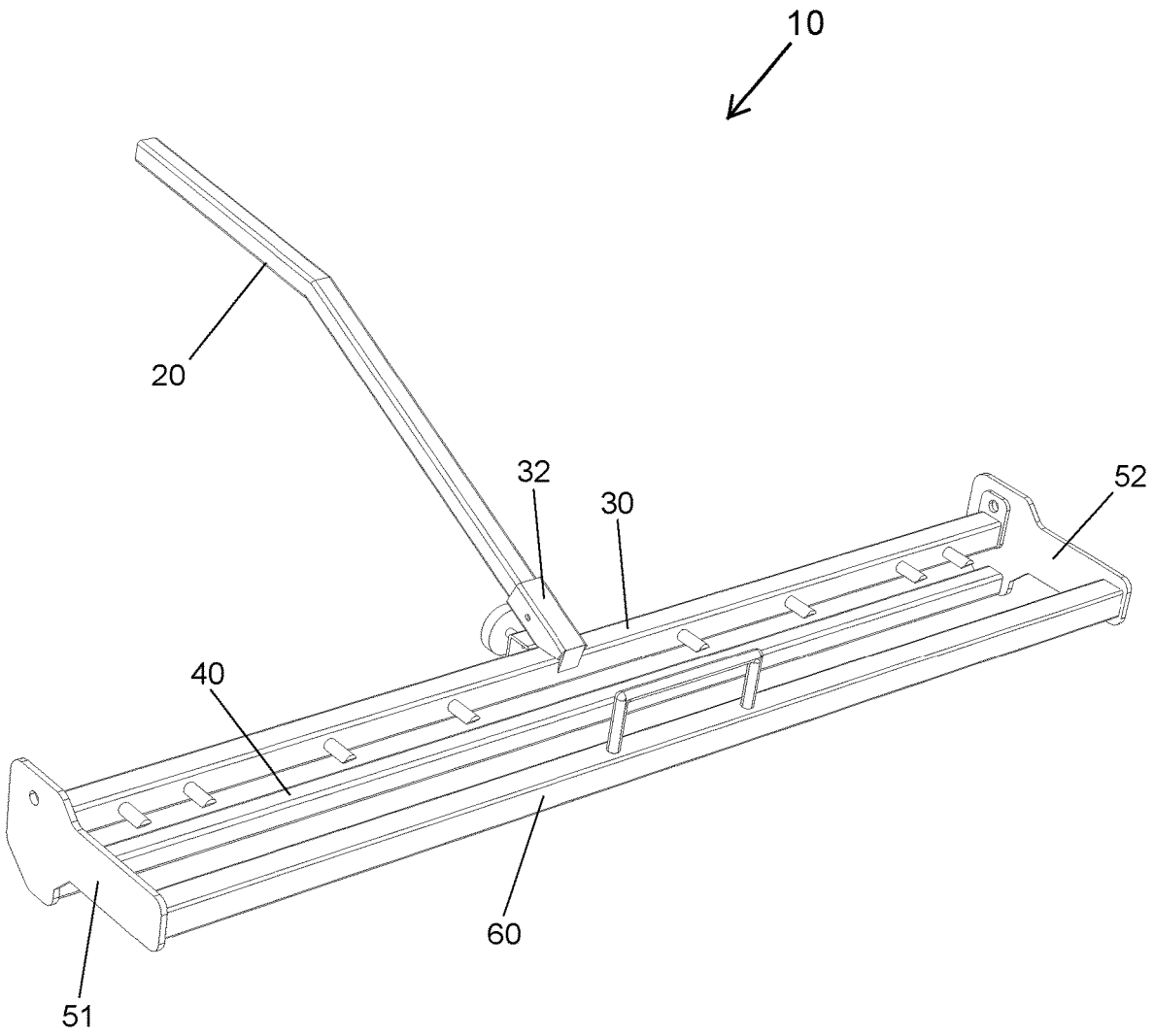
FIG. 1 is a front perspective view of an exemplary tool for removing a runner from an agricultural bin in accordance with some embodiments of the present invention.
Figure 2:
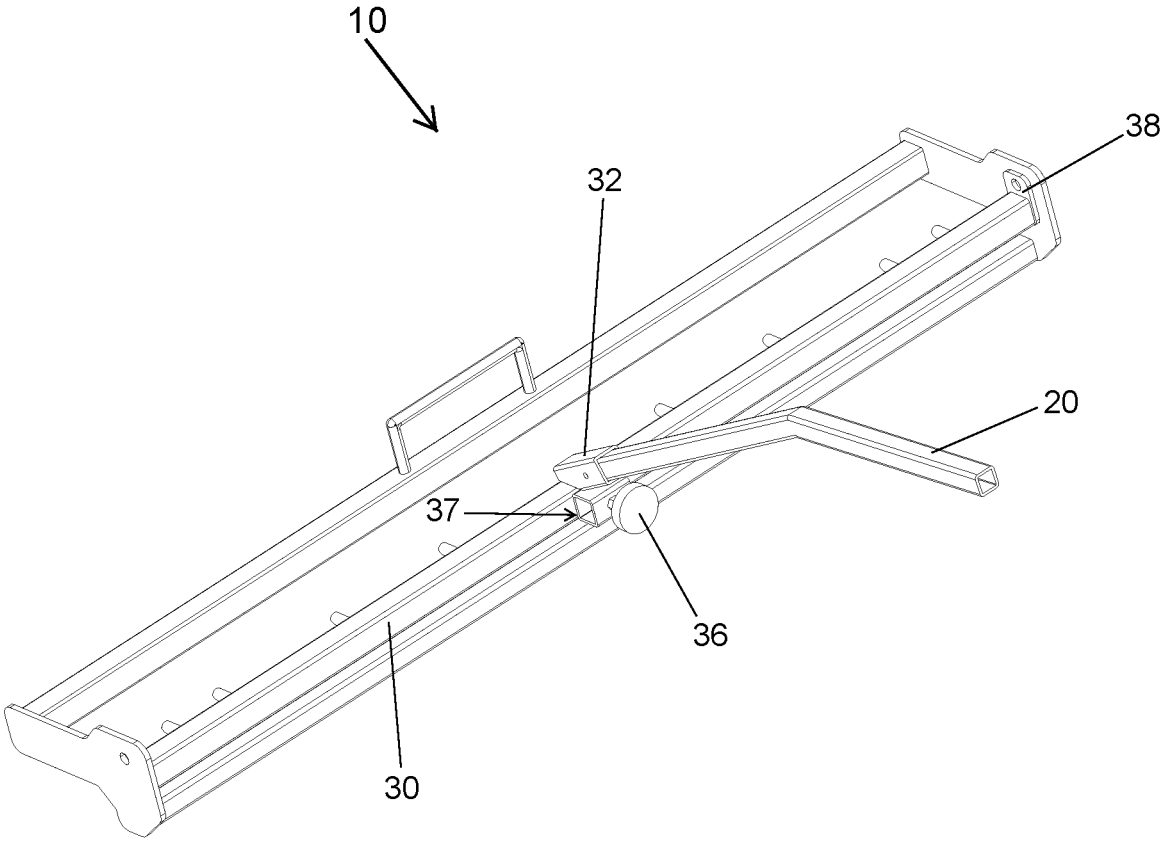
FIG. 2 is a rear perspective view of the tool illustrated FIG. 1.

The present invention is primarily directed to a tool which may be used to remove, or extract, a runner from an agricultural bin, or the like (e.g., harvest bin, produce bin, commodity bin, etc.). A tool may generally include a lever arm and an engagement portion which may comprise one or more side pieces and crossbars, wherein a crossbar may be about perpendicular to the lever arm. For example, referring, generally, to FIG. 1, an exemplary tool 10 is illustrated having a lever arm 20 and an engagement portion comprising an engagement crossbar 30, a proximal crossbar 40, a first side piece 51, a second side piece 52, and a lateral crossbar 60, wherein first side piece 51 and second side piece 52 may each generally comprise a flat plate and wherein engagement crossbar 30, proximal crossbar 40, and lateral crossbar 60 may each be generally elongate. In some embodiments, a lever arm may be oriented, generally, away from a lateral crossbar and may be engaged directly or indirectly with an engagement crossbar. For example, as illustrated in FIGS. 1 and 2, lever arm 20 may be secured to engagement crossbar 30 by means of channel 32, which may be integrally formed with engagement crossbar 30 and within which lever arm 20 can be inserted. It is to be appreciated, however, that in other embodiments, a lever arm may be integrally formed with an engagement crossbar.

Figure 3:
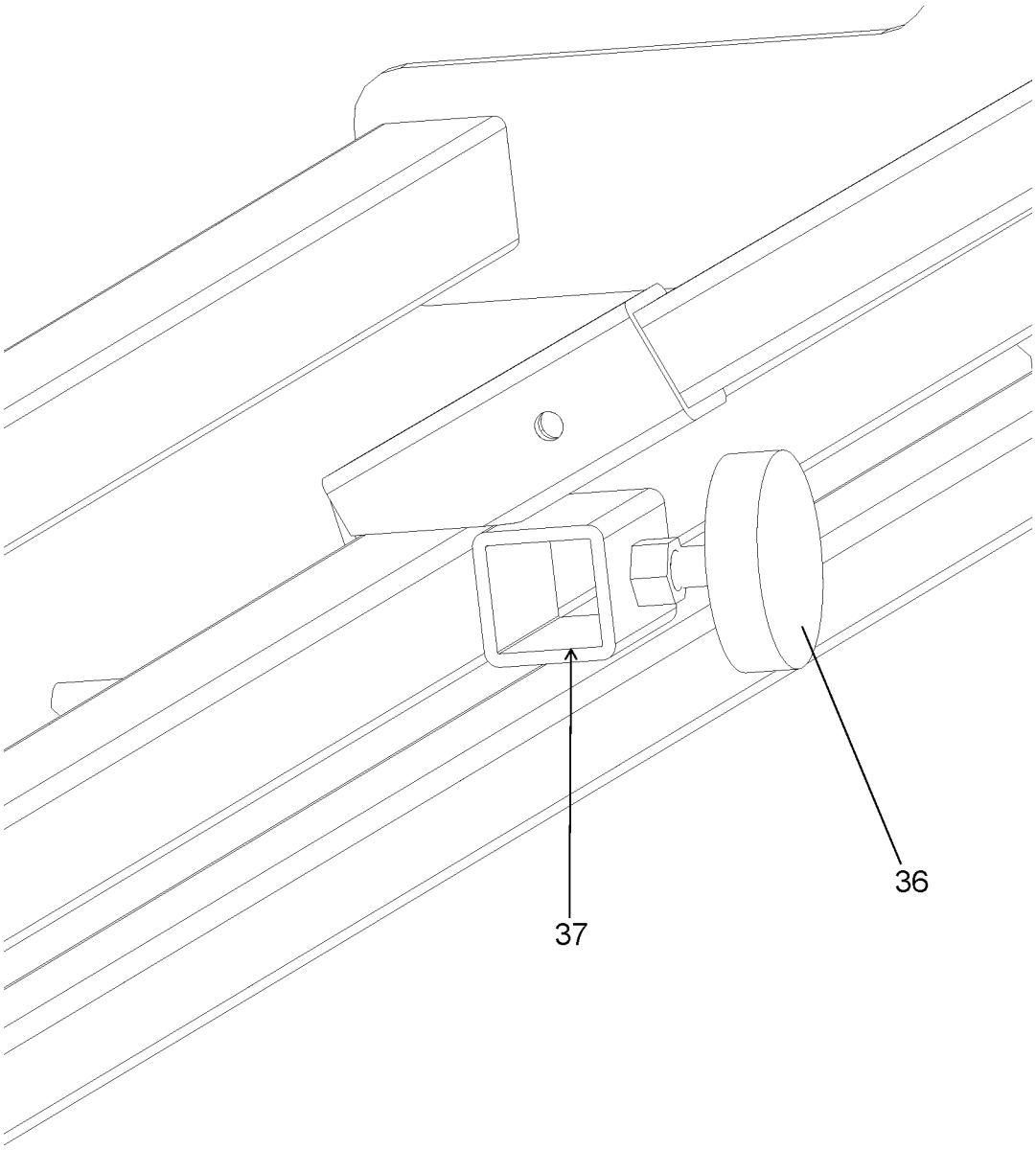
FIG. 3 is a magnified view of a rear central portion of the tool illustrated FIG. 1.

In preferred embodiments of the present invention, a lever arm may be removably engaged with an engagement crossbar. For example, as further illustrated in FIG. 2, lever arm 20 may be removable from channel 32, such that when tool 10 is not being used, a user may remove lever arm 20 and, optionally, store lever arm 20 within slot 37 (shown more clearly in FIG. 3, which may be disposed below channel 32 on a side of engagement crossbar 30. To secure lever arm 20 within slot 37, a dial 36 may be provided which may have a screw, or the like, extending therefrom. Once lever arm 20 is within slot 37, a user may turn dial 36 until lever arm 20 is adequately secured by the screw. To remove lever arm 20, a user may turn dial 36 in an opposite direction until lever arm 20 is able to be removed from slot 37.

Figure 4:
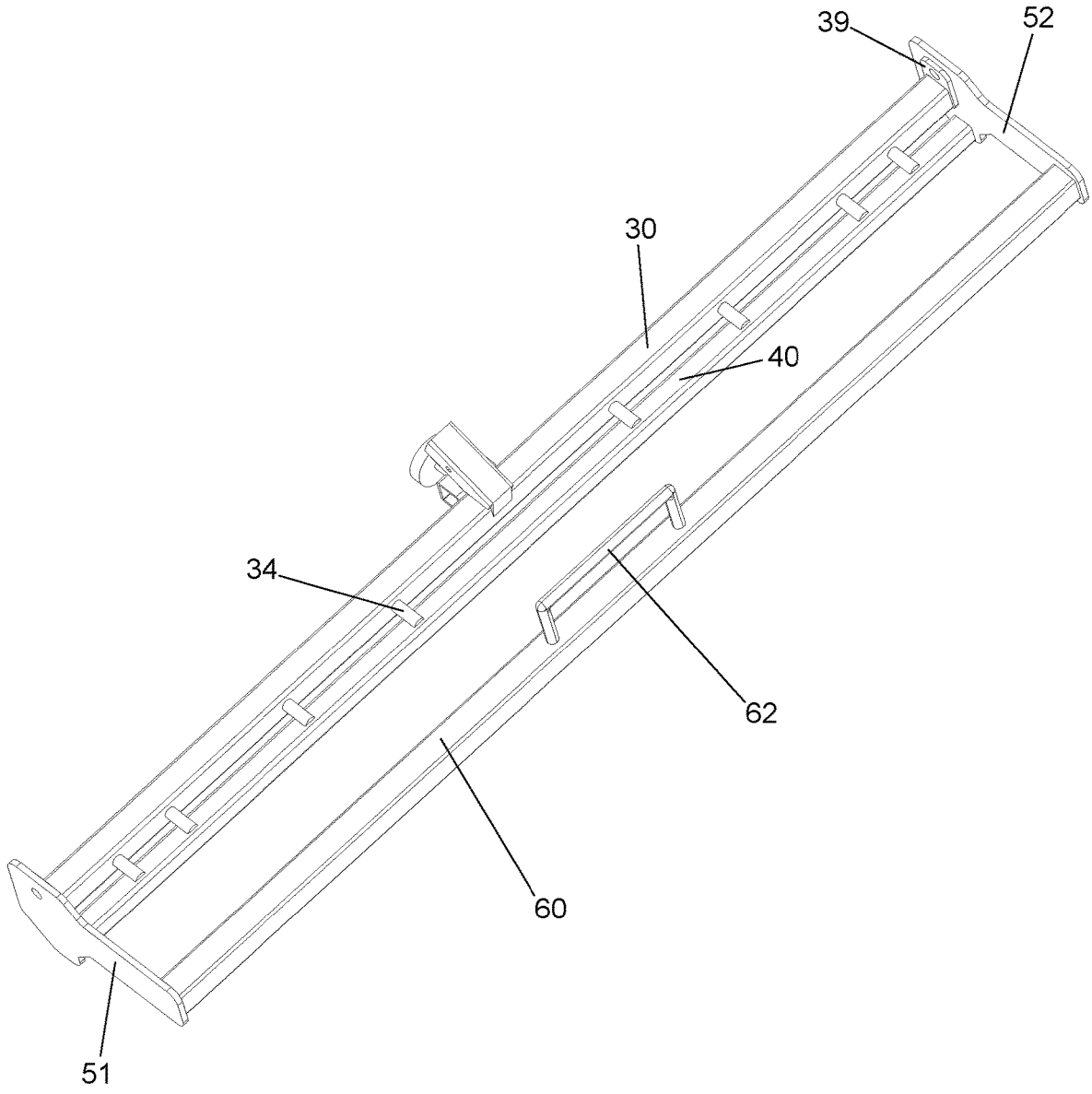
FIG. 4 is a top perspective view of an exemplary engagement portion of the tool illustrated FIG. 1.
Figure 5:
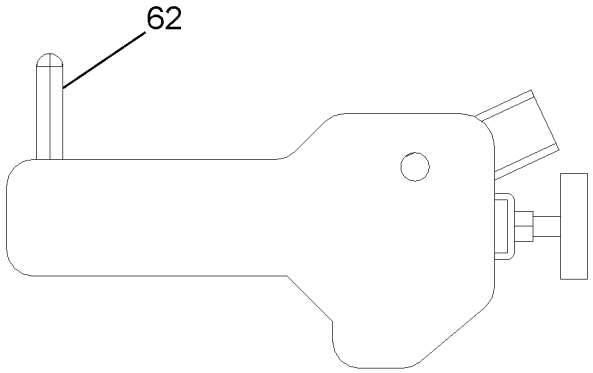
FIG. 5 is a side view of the engagement portion illustrated in FIG. 4.

Referring now, generally, to FIG. 4, the engagement portion of tool 10 is illustrated (i.e., without lever arm 20 inserted). As shown, the distal ends of engagement crossbar 30, proximal crossbar 40, and lateral crossbar 60 may be secured to first side piece 51 (at one distal end) and second side piece 52 (at the other distal end), such that a longitudinal axis of each crossbar is oriented approximately perpendicular to an inner surface of each flat plate of each side piece. As further illustrated, for example, in FIG. 4, a longitudinal axis of each of engagement crossbar 30, proximal crossbar 40, and lateral crossbar 60 may be approximately parallel to each other. FIG. 4 also illustrates that the inner surface of each of proximal crossbar 40 and lateral crossbar 60 may be approximately parallel to each other. In preferred embodiments, a proximal crossbar, engagement crossbar, and lateral crossbar may be generally shaped to have a square crosssection. However, it is to be appreciated that a crossbar may be shaped to have a rectangular, circular, or elliptical cross-section, or any other cross-sectional shape.

In some embodiments, a handle, or the like, may be disposed on a lateral crossbar which may allow a user to safely and more easily maneuver or manipulate a tool. In preferred embodiments, a handle may be disposed near a center of a side of a lateral crossbar and the handle may be oriented such that a user may grasp the handle without having to touch a portion of the lateral crossbar. For example, as further illustrated in FIG. 4, a handle 62 may be integrally formed with lateral crossbar 60 which, for example, may be utilized when a user is securing tool 10 on a leg of an agricultural bin.

In accordance with some embodiments of the present invention, an engagement crossbar, proximal crossbar, and lateral crossbar may be fixedly, rotatably, or pivotally engaged with a side piece. For example, as further illustrated in FIG. 4, engagement crossbar 30 may be rotatably engaged with first side piece 51 and second side piece 52, whereas proximal crossbar 40 and lateral crossbar 60 may each be fixedly engaged with first side piece 51 and second side piece 52. In preferred embodiments, an engagement crossbar may have one or more flanges disposed at a distal end and by which a side piece may be engaged. For example, engagement crossbar 30 may have a first flange 38 (illustrated in FIG. 2) at a first distal end and a second flange 39 at a second distal end, wherein an opening may be formed in each flange for rotatably securing to each side piece by means of a screw or bolt, or the like. As configured, engagement crossbar 30 may be rotatable, relative to proximal crossbar 40 and lateral crossbar 60, around an axis which passes through the opening in first flange 38 and the opening in second flange 39. It is to be appreciated, however, that an engagement crossbar may lack flanges and may be directly and/or rotatably engaged with a side piece. For example, an engagement crossbar may be rotatably engaged with a side piece at near a center of a distal end of the engagement crossbar, thus enabling the engagement crossbar to rotate around a central longitudinal axis. It is further to be appreciated that, in other embodiments of the present invention, a tool may have one or more side pieces which may include slots or openings formed therein, which may allow an engagement crossbar to slidably move within a slot or opening.

In preferred embodiments of the present invention, one or more protrusions may be provided on a crossbar for engaging one or more tabs of an agricultural bin runner. For example, as best illustrated in FIGS. 1, 2, and 4, a plurality of protrusions 34 may be disposed laterally along engagement crossbar 30 and may be oriented, generally, toward lateral crossbar 60. In preferred embodiments, the total number of protrusions provided on an engagement crossbar may be equal to the total number of tabs on an outer portion of a leg of an agricultural bin. In some embodiments, the relative positioning and spacing of each protrusion may correspond to the arrangement and positioning of the tabs on a runner of an agricultural bin. For example, a protrusion may be positioned such that it may be centrally aligned with a corresponding tab of an agricultural bin runner when the engagement portion of a tool is engaged with a leg of the bin. It is to be appreciated, however, that, the number and positioning of protrusions may not necessarily correspond to the number and positioning of tabs provided on a leg of an agricultural bin. For example, the number of tabs on a runner may exceed the number of protrusions on a crossbar.

Figure 6:
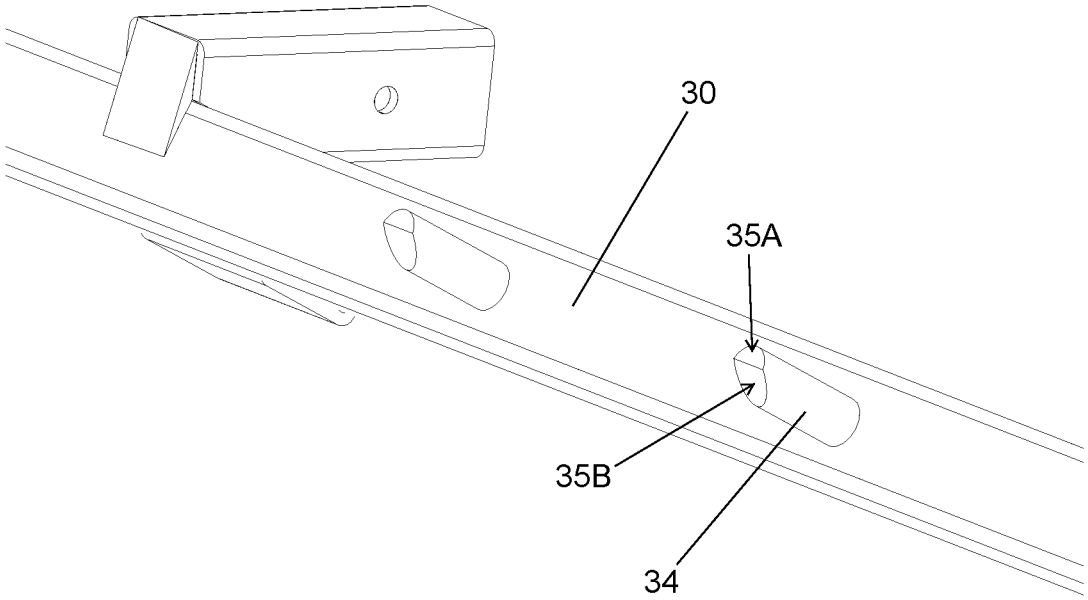
FIG. 6 is a magnified view of a portion of an exemplary engagement crossbar of the tool illustrated in FIG. 1.

In preferred embodiments, a protrusion may generally have a cylindrical shape with a distal end which may be flat (i.e., perpendicular to an axial portion of the protrusion), rounded, chamfered, or beveled. For example, as more clearly illustrated in FIG. 6, the distal ends of protrusions 34 may be beveled, such that a portion 35A of the distal end surfaces may be oblique to an adjacent portion 35B of the distal end surfaces. As configured, when a leg of a bin is engaged by the engagement portion of tool 10 and protrusions 34 make initial contact with corresponding tabs of a runner, each portion 35A of protrusions 34 and each surface of the corresponding tabs may be about parallel to each other, such that the abutting surfaces squarely engage each other without play. As engagement crossbar 30 rotates, protrusions 34 may force the tabs inward and upward to a point where each portion 35A of protrusions 34 and each surface of the tabs begin to disjoin. As engagement crossbar 30 continues to rotate, the points of contact between protrusions 34 and the tab surfaces transitions from portion 35A to portion 35B, while the tabs continue to be forced inward and upward. By each portion 35B being oblique to each portion 35A of the protrusions 34, adequate force may be maintained against the tabs throughout the entire range of rotation of engagement crossbar 30.

Figure 7:
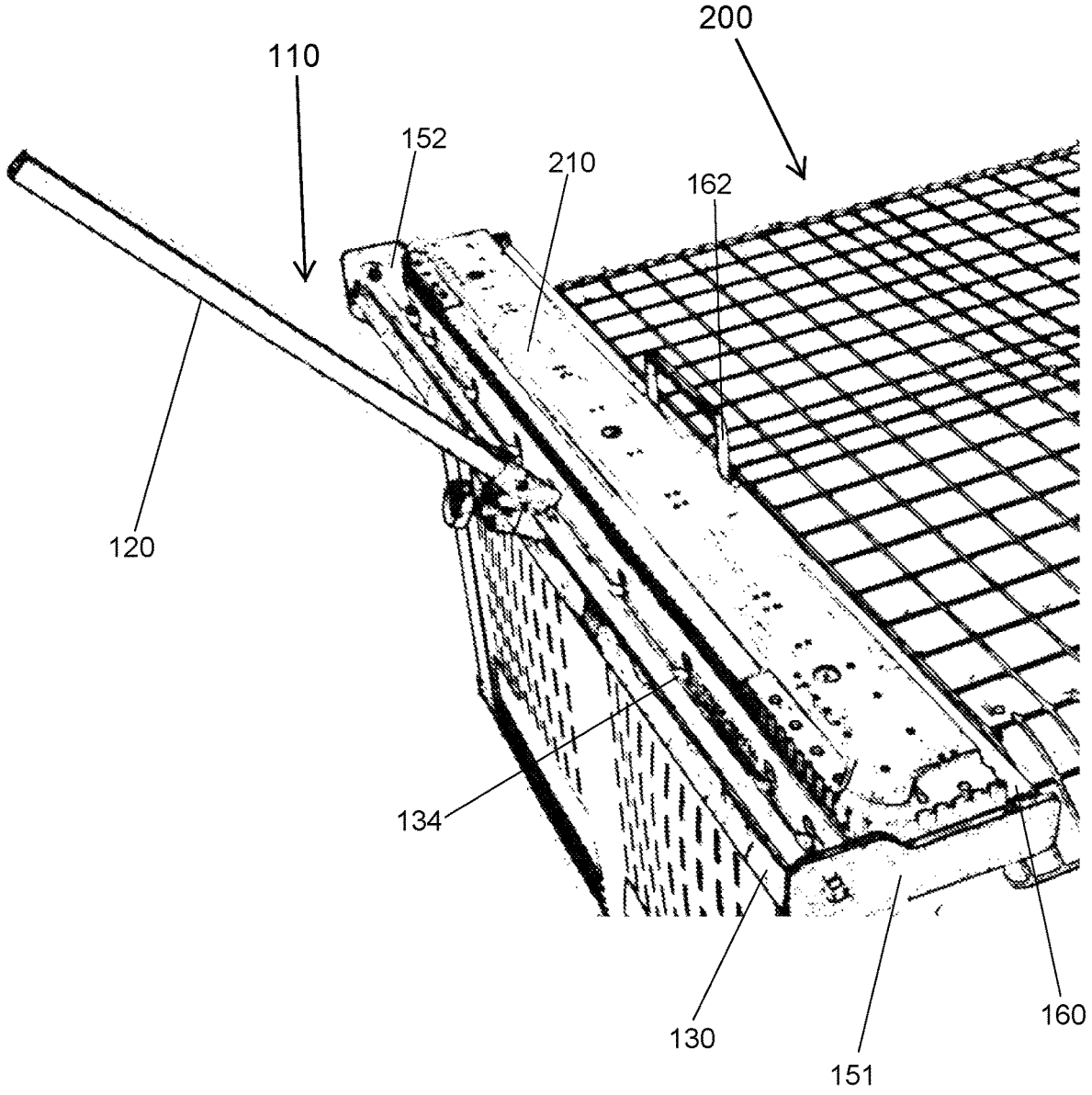
FIG. 7 is a perspective view of an exemplary tool, with a lever arm in a first position, engaged with a leg of an agricultural bin in accordance with some embodiments of the present invention.
Figure 8:
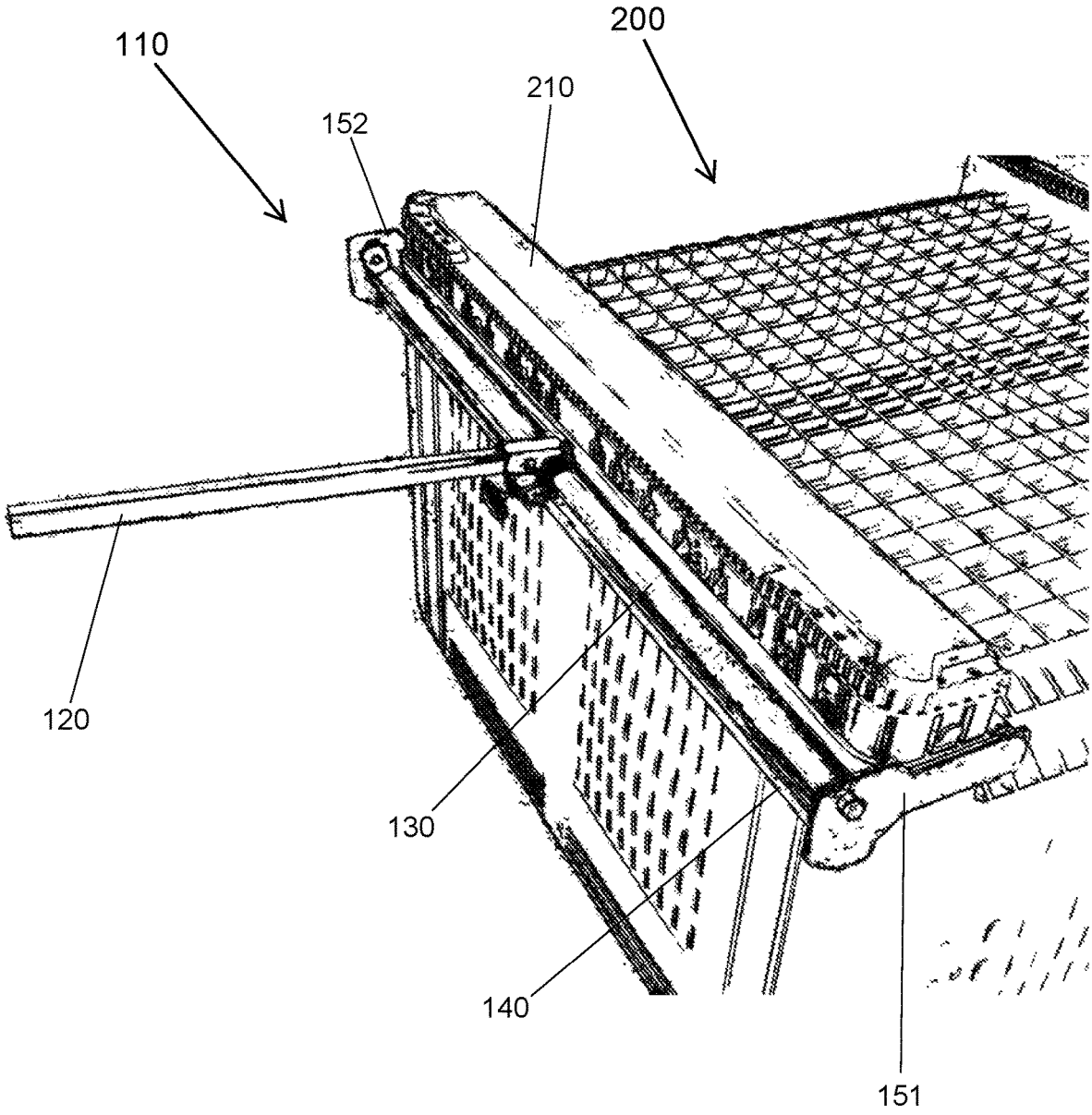
FIG. 8 is a perspective view of the tool and agricultural bin of FIG. 7, wherein the lever arm is in a second position.

When a tool is engaged with a leg of an agricultural bin, a proximal crossbar and a lateral crossbar may help secure the tool by preventing play between any abutting components. In preferred embodiments, a proximal crossbar and a lateral crossbar may be constructed in accordance with the specifications of a leg of an agricultural bin. For example, as illustrated in FIGS. 7 and 8, an exemplary tool 110 may have a proximal crossbar 140 and a lateral crossbar 160 which may be spaced apart such that a leg of an agricultural bin 200 (with a runner 210 engaged therein) may be tightly secured proximal crossbar 140 and lateral crossbar 160. Furthermore, the lengths of proximal crossbar 140 and lateral crossbar 160 may be approximately equal to the length of the leg of bin 200 such that, when the distal ends of proximal crossbar 140 and lateral crossbar 160 are secured by a first side piece 151 and a second side piece 152 (or the like), lateral movement of tool 110 may be limited or minimized. It is to be appreciated, however, that the spacing between crossbars and the lengths thereof may vary in accordance with different types and dimensions of agricultural bins.

In preferred embodiments, an engagement crossbar may be slightly offset from a proximal crossbar such that the engagement crossbar, or a portion thereof, may not contact a leg of an agricultural bin when being secured thereto. For example, as further illustrated in FIG. 7, when tool 110 is secured on the leg of bin 200, engagement bar 130 may be separated from the leg such that the outer portion thereof may not contact one or more of protrusions 134. This may allow engagement crossbar 130 to rotate freely and engage protrusions 134 with the tabs of runner 210 (as shown, for example, in FIG. 8).

In one implementation of the present invention, a tool may be used to remove a runner when, for example, the runner has been worn out and the agricultural bin to which it is attached is still viable. Referring, generally, to the exemplary illustrations of FIGS. 7 and 8, a user may begin by placing agricultural bin 200 upside down so that the legs thereof are freely accessible. Using tool 110, the user may place the engagement portion of tool 110 around the leg from which runner 210 is to be removed, ensuring that lever arm 120 of tool 110 is in a disengaged position, (i.e., the position illustrated in FIG. 7). In some cases, the user may utilize handle 162 which may be disposed on a side of lateral crossbar 160 and oriented away from the bottom of bin 200.

The leg of bin 200 may be positioned within the engagement portion such that i) protrusions 134 may be aligned with the tabs of runner 210, ii) proximal crossbar 140 (illustrated in FIG. 8) may be squarely secured to the outer portion of the leg, and iii) lateral crossbar 160 (illustrated in FIG. 7) may be squarely secured to the inner portion of the leg. Once the leg of bin 200 is securely engaged and protrusions 134 are properly aligned, the user may press down on lever arm 120, causing engagement crossbar 130 to rotate and initiate contact between protrusions 134 and each of the corresponding tabs of runner 210. As the user continues to press down on lever arm 120 (and engagement crossbar 130 continues to rotate), protrusions 134 force the corresponding tabs of runner 210 inwards and upwards. By forcing the tabs inwards, the tabs disengage from their corresponding grooves (or openings) in the leg of bin 200 and, by simultaneously forcing the tabs upwards, the tabs are prevented from re-engaging the corresponding grooves. The user may continue to press down on lever arm 120 until the tabs have been completely disengaged from the corresponding grooves within the leg of bin 200 and until the rotation of engagement crossbar 130 and the force from protrusions 134 has caused a substantial portion of runner 210 to be pushed out from the leg of bin 200, as illustrated in FIG. 8. Once this is achieved, the user may finish removing runner 210 from the leg by hand. In some cases, a runner may have one or more additional tabs on a corner, perpendicular to the tabs which have been disengaged. In such cases, a user may need to manually disengage the one or more tabs before the runner can be completely removed. Once a runner is removed, it may be discarded and replaced with a new runner.

In addition to the embodiments discussed above, it is to be understood that a tool may be adapted to accommodate various types of agricultural bins. For example, a tool may have one or more additional crossbars which may be positioned to provide for more leverage as an engagement crossbar rotates. In some embodiments, a tool may have adjustable protrusions which may be positioned in accordance with the arrangement of tabs on a runner. In other embodiments, one or more protrusions may be spring loaded which may reduce the amount of manual force needed to be applied by a user. Furthermore, it may be possible to have an adjustable engagement portion (i.e., adjustable crossbars) which may be extended or retracted to accommodate different leg sizes of a bin.

It is to be understood that variations, modifications, and permutations of embodiments of the present invention may be made without departing from the scope thereof. It is also to be understood that the present invention is not limited by the specific embodiments, descriptions, or illustrations or combinations of either components or steps disclosed herein. Thus, although reference has been made to the accompanying figures, it is to be appreciated that these figures are exemplary and are not meant to limit the scope of the invention.

What is claimed is:

1. A tool for removing a runner from an agricultural bin, comprising a lever arm and an engagement portion, said engagement portion comprising:

a) an engagement crossbar comprising at least one protrusion and a longitudinal axis, said engagement crossbar further comprising a flange at each distal end and a rotational axis through each flange;

b) a proximal crossbar;

c) a lateral crossbar; and d) a first side piece and a second side piece, each side piece comprising a generally flat plate having an inner surface;

wherein said lever arm is engaged with said engagement crossbar, wherein said engagement crossbar is connected along said rotational axis with, each inner surface of each flat plate, wherein said proximal crossbar is directly connected and perpendicular to each inner surface of each flat plate, wherein said lateral crossbar is directly connected and perpendicular to each inner surface of each flat plate, and wherein said longitudinal axis of said engagement crossbar is parallel to, and rotatable around, said rotational axis.

2. The tool of claim 1, wherein said lever arm is removably engaged with said engagement crossbar.

3. The tool of claim 2, wherein said tool further comprises a slot for storing said lever arm.

4. The tool of claim 1, wherein a distal end of said at least one protrusion of said engagement crossbar is beveled.

5. The tool of claim 1, wherein said at least one protrusion of said engagement crossbar further comprises a plurality of protrusions.

6. The tool of claim 1, wherein said engagement portion further comprises a handle disposed on said lateral crossbar.

7. The tool of claim 1, wherein said at least one protrusion extends toward said lateral crossbar and wherein a proximal portion of said lever arm extends away from said lateral crossbar.

8. The tool of claim 1, wherein said longitudinal axis of said engagement crossbar, a longitudinal axis of said proximal crossbar, and a longitudinal axis of said lateral crossbar are each parallel to each other.

9. The tool of claim 1, wherein said longitudinal axis of said engagement crossbar, a longitudinal axis of said proximal crossbar, and a longitudinal axis of said lateral crossbar are each perpendicular to each inner surface of each flat plate.

10. The tool of claim 1, wherein an inner surface of each of said proximal crossbar and said lateral crossbar are parallel to each other.

11. A system for removing a runner from an agricultural bin using an extraction tool, wherein said runner is engaged within a leg of said bin, said extraction tool comprising:

a) a lever arm;

b) an engagement crossbar comprising at least one protrusion for engaging at least one tab of said runner, said engagement crossbar further comprising a longitudinal axis, a flange at each distal end, and a rotational axis through each flange;

c) a proximal crossbar for securing a portion of said tool on an outer portion of said leg of said bin;

d) a lateral crossbar for securing a portion of said tool on an inner portion of said leg of said bin; and e) a first side piece and a second side piece, each side piece comprising a generally flat plate having an inner surface;

wherein said lever arm is engaged with said engagement crossbar, wherein said engagement crossbar is connected along said rotational axis with each inner surface of each flat plate wherein said proximal crossbar is directly connected and perpendicular to each inner surface of each flat plate, wherein said lateral crossbar is directly connected and perpendicular to each inner surface of each flat plate, and wherein said longitudinal axis of said engagement crossbar is parallel to, and rotatable around, said rotational axis.

12. The system of claim 11, wherein a distal end of said at least one protrusion is beveled.

13. The system of claim 11, wherein said tool further comprises a handle disposed on said lateral crossbar for securing said tool on said leg of said bin.

14. The system of claim 11, wherein said lever arm is removably engaged with said engagement crossbar.

15. The system of claim 14, wherein said tool further comprises a dial and a slot for storing said lever arm, wherein said dial is for securing said lever arm within said slot.

16. The system of claim 11, wherein said at least one protrusion extends toward said lateral crossbar and wherein a proximal portion of said lever arm extends away from said lateral crossbar.

17. The system of claim 11, wherein said longitudinal axis of said engagement crossbar, a longitudinal axis of said proximal crossbar, and a longitudinal axis of said lateral crossbar are each parallel to each other.

18. The system of claim 11, wherein said longitudinal axis of said engagement crossbar, a longitudinal axis of said proximal crossbar, and a longitudinal axis of said lateral crossbar are each perpendicular to each inner surface of each flat plate.

19. The system of claim 11, wherein an inner surface of each of said proximal crossbar and said lateral crossbar are parallel to each other.

20. A tool for removing a runner from an agricultural bin, comprising:

a) a lever arm;

b) an engagement crossbar comprising at least one protrusion and a longitudinal axis, said engagement crossbar further comprising a flange at each distal end and a rotational axis through each flange;

c) a proximal crossbar;

d) a lateral crossbar; and e) a first side piece and a second side piece, each comprising a generally flat plate having an inner surface;

f) wherein said lever arm is removably engaged with said engagement crossbar, wherein said engagement crossbar is connected along said rotational axis with each inner surface of each flat plate, wherein said proximal crossbar and said lateral crossbar are each fixedly connected and perpendicular to each inner surface of each flat plate, wherein said longitudinal axis of said engagement crossbar is parallel to, and rotatable around, said rotational axis, wherein a distal end of said at least one protrusion is beveled, wherein said at least one protrusion extends toward said lateral crossbar and wherein a proximal portion of said lever arm extends away from said lateral crossbar, and wherein said engagement crossbar, said proximal crossbar, and said lateral crossbar are each connected and perpendicular to an inner surface of said flat plate of each of said first side piece and said second side piece.

* * * * *